US010933660B2

(12) United States Patent
Shibata et al.

(10) Patent No.: US 10,933,660 B2
(45) Date of Patent: Mar. 2, 2021

(54) OUTPUT TENSION ZONES

(71) Applicant: Hewlett-Packard Development Company, L.P., Spring, TX (US)

(72) Inventors: Alan Shibata, Vancouver, WA (US); Richard Lee Brinkly, Vancouver, WA (US); Matthew Raisanen, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/480,982

(22) PCT Filed: Feb. 1, 2017

(86) PCT No.: PCT/US2017/015980
§ 371 (c)(1),
(2) Date: Jul. 25, 2019

(87) PCT Pub. No.: WO2018/143976
PCT Pub. Date: Aug. 9, 2018

(65) Prior Publication Data

US 2020/0001623 A1 Jan. 2, 2020

(51) Int. Cl.

| | |
|---|---|
| ***B41J 11/00*** | (2006.01) |
| *B41J 13/076* | (2006.01) |
| *B65H 23/188* | (2006.01) |
| *B65H 23/34* | (2006.01) |

(52) U.S. Cl.
CPC ..... *B41J 11/0005* (2013.01); *B41J 11/002* (2013.01); *B41J 13/076* (2013.01); *B65H 23/1888* (2013.01); *B65H 23/34* (2013.01); *B65H 2511/22* (2013.01)

(58) Field of Classification Search
CPC ..... B41J 11/0005; B41J 11/002; B41J 11/045; B41J 11/02; B41J 13/08; B41J 13/076; B41J 15/16; B41J 15/165; B65H 23/34
See application file for complete search history.

(56) References Cited

U.S. PATENT DOCUMENTS

| | | | |
|---|---|---|---|
| 8,297,748 | B2 | 10/2012 | Chiwata |
| 9,156,283 | B2 | 10/2015 | Boland et al. |
| 9,242,456 | B2 | 1/2016 | Qi et al. |
| 9,315,050 | B2 | 4/2016 | Studer et al. |

(Continued)

FOREIGN PATENT DOCUMENTS

EP 0373922 * 12/1989 ..... B41J 211/002

*Primary Examiner* — Juanita D Jackson
(74) *Attorney, Agent, or Firm* — Brooks Cameron & Huebsch PLLP

(57) ABSTRACT

In one example, an output tension zone can include a first tension roller assembly to receive partially dried inkjet media at an output of a heated pressure roller, wherein the first tension roller assembly includes a first continuous roller to receive a first side of the partially dried inkjet media and a second continuous roller to receive a second side of the partially dried inkjet media and a second tension roller assembly to receive the partially dried inkjet media from the first tension roller assembly, wherein the second tension roller assembly includes a third continuous roller to receive the first side of the partially dried inkjet media and a fourth continuous roller to receive the second side of the partially dried inkjet media.

13 Claims, 3 Drawing Sheets

(56) References Cited

U.S. PATENT DOCUMENTS

| | | | | |
|---|---|---|---|---|
| 9,423,177 | B2 | 8/2016 | Walker et al. | |
| 2002/0110400 | A1* | 8/2002 | Beehler et al. | |
| 2011/0074859 | A1 | 3/2011 | Byun et al. | |
| 2013/0135415 | A1 | 5/2013 | Claramunt et al. | |
| 2013/0328959 | A1* | 12/2013 | Akira et al. ..... | B41J 11/005 |
| 2016/0077481 | A1 | 3/2016 | Katano et al. | |

* cited by examiner

OUTPUT TENSION ZONES

BACKGROUND

Inkjet printers can deposit quantities of printing fluid onto a printable media (e.g., paper, plastic, etc.). In some examples, inkjet printers can create a curl and/or cockle in the printed media when the printing fluid droplets are deposited by the inkjet printer. In some examples, a number of physical properties of the printable media can be changed when the printing fluid droplets are deposited by the inkjet printer. For example, the stiffness of the printable media can be changed when the printing fluid droplets are deposited by the inkjet printer. The curl, cockle, and/or other physical properties that change due to the printing fluid droplets can make document finishing processes difficult.

DETAILED DESCRIPTION

Figure 1:
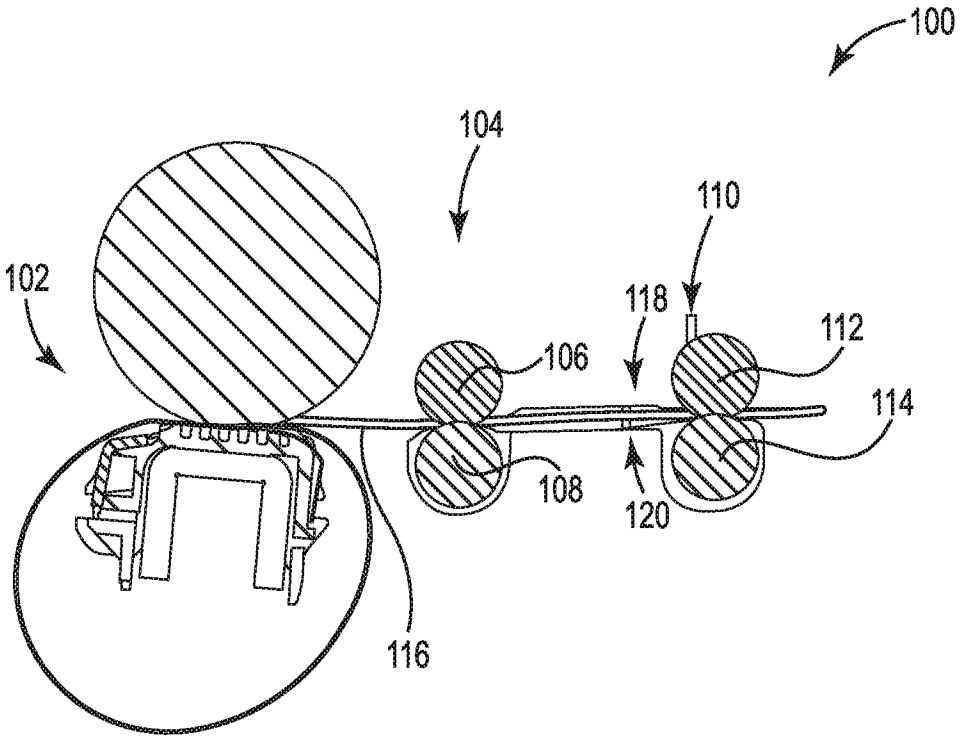
FIG. 1 illustrates an example output tension zone consistent with the present disclosure.

A number of systems and devices for an output tension zone are described herein. In some examples, an output tension zone can include an output of a heated pressure roller, wherein the first tension roller assembly includes a first continuous roller to receive a first side of the partially dried inkjet media and a second continuous roller to receive a second side of the partially dried inkjet media and a second tension roller assembly to receive the partially dried inkjet media from the first tension roller assembly, wherein the second tension roller assembly includes a third continuous roller to receive the first side of the partially dried inkjet media and a fourth continuous roller to receive the second side of the partially dried inkjet media.

The partially dried inkjet media can provide difficulties when stacking, aligning, and/or finishing. For example, the partially dried inkjet media can have distorted properties such as a curl, a cockle, a reduction in stiffness, increased surface roughness, extruding or protruding fibers from the surface, misaligned fibers, and/or increased sheet to sheet friction of the media. In some examples, these distorted properties can be caused by printing fluid deposited on the media and the media absorbing the printing fluid. For example, the printing fluid can be in a liquid state that can be absorbed by a media such as paper. In this example, the liquid state of the printing fluid can cause the distorted properties of the media in a similar way that other liquids may distort the properties of the media.

In some examples, an output tension zone can be utilized to increase evaporation of printing fluid applied to the partially dried inkjet media. In some examples, the output tension zone can remove or reduce the distorted properties generated by the printing fluid applied to the partially dried inkjet media. For example, the partially dried inkjet media can include extruding fibers from the surface that can be embedded into the surface of the partially dried inkjet media by the pressure applied by a plurality of tension roller assemblies and/or a tension provided to the partially dried inkjet media by the plurality of tension roller assembly. In some examples, the output tension zone can include a heated pressure roller with the plurality of tension roller assemblies positioned at the output of the heated pressure roller.

As used herein, the plurality of tension roller assemblies can include a first continuous roller and a second continuous roller that are positioned to receive partially dried inkjet media. The first continuous roller and the second continuous roller can act together to apply pressure and/or tension on the partially dried inkjet media as described further herein. For example, the first continuous roller and the second continuous roller can be controlled to rotate at speeds that correspond to applying pressure and/or tension on the partially dried inkjet media. In this example, the first continuous roller can be controlled to rotate at a first speed and the second continuous roller can be controlled to rotate at a second speed. In some examples, the first speed and the second speed can be adjusted such that the first continuous roller and the second continuous roller work together. In some examples, the first speed and the second speed can be the same speed or different speeds depending on a particular level of pressure or tension to be applied to the partially dried inkjet media. The plurality of tension roller assemblies can be different than independent rollers or other rollers that include a top roller and a bottom roller. For example, the independent rollers can function separately and without consideration of other rollers (e.g., bottom roller or top roller, etc.).

In some examples, the output tension zone can utilize continuous rollers to apply even pressure across the partially dried inkjet media. As used herein, continuous rollers can include cotless rollers (e.g., tireless rollers, rollers without a plurality of discrete tires, rollers without a plurality of contact surfaces such as tires, etc.) that have substantially equal levels of material that interact with a surface of the partially dried inkjet media. Non-continuous rollers can include a plurality of cots positioned along a shaft of the non-continuous roller. In some examples, a non-continuous roller could apply inconsistent pressure to particular portions of the partially dried inkjet media. In these examples, the cots of the non-continuous roller can generate indents at the corresponding positions of the cots as the partially dried inkjet media dries in the output tension zone.

In some examples, the output tension zone can apply pressure, heat, and/or air circulation to the partially dried inkjet media. The application of pressure, heat, and/or air circulation can increase drying of the partially dried inkjet media and increase removal of the distorted properties generated by the printing fluid applied to the partially dried inkjet media. In some examples, the applied pressure and tension provided by the continuous tension rollers while the partially dried inkjet media is drying can remove a greater quantity of distorted properties compared to allowing the partially dried inkjet media to dry without applied pressure or tension.

The figures herein follow a numbering convention in which the first digit corresponds to the drawing figure number and the remaining digits identify an element or component in the drawing. Elements shown in the various figures herein may be capable of being added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense.

FIG. 1 illustrates an example output tension zone 100 consistent with the present disclosure. In some examples, the output tension zone 100 can receive partially dried inkjet media 116 from a print zone of a printing device. As used herein, the print zone includes an area within a print engine of an inkjet printer to deposit printing fluid on a print media (e.g., paper, plastic, etc.). In some examples, the print zone can include a plurality of inkjet heads that can deposit a printing fluid on the print media to generate an image on the print media. As described herein, the printing fluid deposited on the print media can generate partially dried inkjet media 116 that includes a number of distorted properties.

In some examples, the output tension zone 100 can include a heated pressure roller assembly 102. In some examples, the heated pressure roller assembly 102 can include a pressure roller to apply pressure to a first side 118 of the partially dried inkjet media 116 and a heated roller to apply heat to a second side 120 of the partially dried inkjet media 116. As illustrated in FIG. 1, the heated pressure roller assembly 102 can apply pressure to a top side of the partially dried inkjet media 116 and apply heat to a bottom side of the partially dried inkjet media 116. In some examples, the heated pressure roller assembly 102 can apply pressure to a printed side of the partially dried inkjet media 116 and apply heat to a non-printed side of the partially dried inkjet media 116.

The output tension zone 100 can include a first tension roller assembly 104 to receive the partially dried inkjet media 116 from the heated pressure roller assembly 102 and/or from the print zone. In some examples, the first tension roller assembly 104 can include a first continuous roller 106 to apply pressure to a first side 118 of the partially dried inkjet media 116 and a second continuous roller 108 to apply pressure to a second side 120 of the partially dried inkjet media 116.

In some examples, an edge of the first continuous roller 106 and an edge of the second continuous roller 108 can include a reverse crown to apply tension on the partially dried inkjet media 116 across the width of the partially dried inkjet media 116, For example, the edge first continuous roller 106 and an edge of the second continuous roller 108 can include a slightly larger diameter compared to a center portion of the first continuous roller 106 and a center portion of the second continuous roller 108. In some examples, each edge of each continuous roller of the output tension zone 100 can include a reverse crown to apply tension on the partially dried inkjet media 116.

As described herein, the first continuous roller 106 and the second continuous roller 108 can be cotless rollers (e.g., tireless rollers, rollers without a plurality of discrete tires, rollers without a plurality of contact surfaces such as tires, etc.) that have substantially equal levels of material that interact with a surface of the partially dried inkjet media. For example, the first continuous roller 106 and the second continuous roller 108 can each comprise a metallic shaft with a substantially equal level of coating material applied to the metallic shaft. In some examples, the metallic shaft can comprise aluminum, stainless steel, and/or a combination of other metals.

In some examples, the level of coating material can be utilized to apply substantially equal pressure across a surface of a corresponding side of the partially dried inkjet media 116. The coating material can be a number of coating materials. For example, the coating material can be a polytetrafluoroethylene (PTFE) based material that is applied such that the PTFE based material applies substantially equal pressure to the partially dried inkjet media 116 from a first edge to a second edge.

In some examples, the first continuous roller 106 and/or the second continuous roller 108 can be connected to a spring mechanism to apply pressure to the first side 118 and/or the second side 120 of the partially dried inkjet media 116. For example, a spring mechanism can apply a force on the first continuous roller 106 in a direction toward the second continuous roller 108. In another example, the spring mechanism can apply a force on the second continuous roller 108 in a direction toward the first continuous roller 106. In this way the first continuous roller 106 and/or the second continuous roller 108 can apply pressure to the first side 118 and the second side 120 of the partially dried inkjet media 116 as the partially dried inkjet media 116 passes through the first tension roller assembly 104.

The output tension zone 100 can include a second tension roller assembly 110 to receive the partially dried inkjet media 116 from the first tension roller assembly 104. In some examples, the second tension roller assembly 110 can include a third continuous roller 112 to apply pressure to a first side 118 of the partially dried inkjet media 116 and a fourth continuous roller 114 to apply pressure to a second side 120 of the partially dried inkjet media 116.

In some examples, the second tension roller assembly 110 can be a similar tension roller assembly as the first tension roller assembly 104, For example, the second tension roller assembly 110 can include a third continuous roller 112 and a fourth continuous roller 114 that can each be a cotless roller as described herein (e.g., tireless rollers, rollers without a plurality of discrete tires, rollers without a plurality of contact surfaces such as tires, etc.), In this example, the third continuous roller 112 and the fourth continuous roller 114 can each comprise a metallic material that is coated with a coating material to apply a substantially equal quantity of pressure across the partially dried inkjet media 116.

In some examples, the first tension roller assembly 104 and the second tension roller assembly 110 can be utilized to apply tension on the partially dried inkjet media 116. For example, the first tension roller assembly 104 can be connected to a first motor to rotate the first tension roller assembly 104 at a first speed. In this example, the second tension roller assembly 110 can be connected to a second motor to rotate the second tension roller assembly 110 at a second speed. In this example, the difference between the first speed and the second speed can apply tension on the partially dried inkjet media 116. In some examples, the tension can be applied to the partially dried inkjet media 116 while drying to restore a number of the distorted properties as described herein. In some examples, the applied tension to the partially dried inkjet media 116 can remove more of the distorted properties compared to systems that do not apply tension to the partially dried inkjet media 116.

As described herein, the first tension roller assembly 104 and the second tension roller assembly 110 can utilize a number of continuous rollers instead of cotted rollers. In addition, the first tension roller assembly 104 and the second tension roller assembly 110 can be utilized to apply tension on the partially dried inkjet media 116. In these examples, the continuous rollers of the first tension roller assembly 104 and the second tension roller assembly 110 can provide equal tension along a length of the partially dried inkjet media 116. For example, a cotted roller can provide tension on the partially dried inkjet media 116 that can cause unequal tension and result in "waves" or distortions along the length of the partially dried media 116 at corresponding locations of the plurality of cots. By utilizing continuous rollers without cots, the first tension roller assembly 104 and second tension roller assembly 110 can apply equal tension to remove distorted properties of the partially dried inkjet media without causing waves or distortions from the tension.

In some examples, the output tension zone 100 can provide tension across the length of the partially dried inkjet media 116 utilizing the heated pressure roller assembly 102, the first tension roller assembly 104, and the second tension roller assembly 110. For example, the heated pressure roller assembly 102 can be rotating at a first speed, the first tension roller assembly 104 can be rotating at a second speed, and the second tension roller assembly 110 can be rotating at a third speed. In this example, the third speed can be relatively faster than the second speed, and the second speed can be relatively faster than the first speed. In this example, the second speed can be approximately three percent faster than the first speed and the third speed can be approximately five percent faster than the second speed. As used herein, the term "approximately" includes a variation of one to three percent of the value.

In some examples, the output tension zone 100 can include an air circulation unit that can provide air flow between the first tension roller assembly 104 and the second tension roller assembly 110. In some examples, exterior air (e.g., air outside the printing device, etc.) can be forced into the output tension zone 100. In some examples, the air circulation unit can force air on a first side 118 of the partially dried inkjet media 116 and/or force air on a second side 120 of the partially dried inkjet media 116.

The air forced onto the partially dried inkjet media 116 can be utilized to increase drying and/or remove moisture from the output tension zone 100. In some examples, the air circulation unit can force exterior air on to the partially dried inkjet media 116 at an input and allow the air to be forced out of the output tension zone 100 to increase drying and remove moisture from the output tension zone 100. Removing moisture from the output tension zone 100 can limit condensation within the output tension zone 100 which can damage the partially dried inkjet media 116.

In some examples, the tension roller assemblies 104, 110 can act as an air flow barrier along a direction of the paper feed. As described herein, the tension roller assemblies 104, 110 can utilize continuous rollers instead of cotted rollers. In these examples, the continuous rollers can prevent the air forced onto the partially dried inkjet media from entering surrounding systems of the output tension zone 100. In some examples, the continuous rollers can also prevent heat and/or humidity from entering surrounding systems of the output tension zone 100. In some examples, the continuous rollers can prevent heat from drawn away from a heated pressure roller assembly 102. Thus, the continuous rollers can create an isolated zone between the first tension roller assembly 104 and the second tension roller assembly 104, In some examples, the isolated zone can be more easily controlled. For example, the air flow, temperature, and/or humidity level of the isolated zone can be more easily controlled compared to a non-isolated zone that can result from utilizing cotted rollers.

The air forced onto the partially dried inkjet media 116 can increase drying of the partially dried inkjet media 116. Increasing the drying of the partially dried inkjet media 116 within the output tension zone 100 can remove a greater quantity of distorted properties. For example, increasing the drying of the partially dried inkjet media 116 while the partially dried inkjet media 116 is under pressure and/or under tension from the tension roller assemblies 104, 110 can remove a greater quantity of distorted properties.

Figure 2:
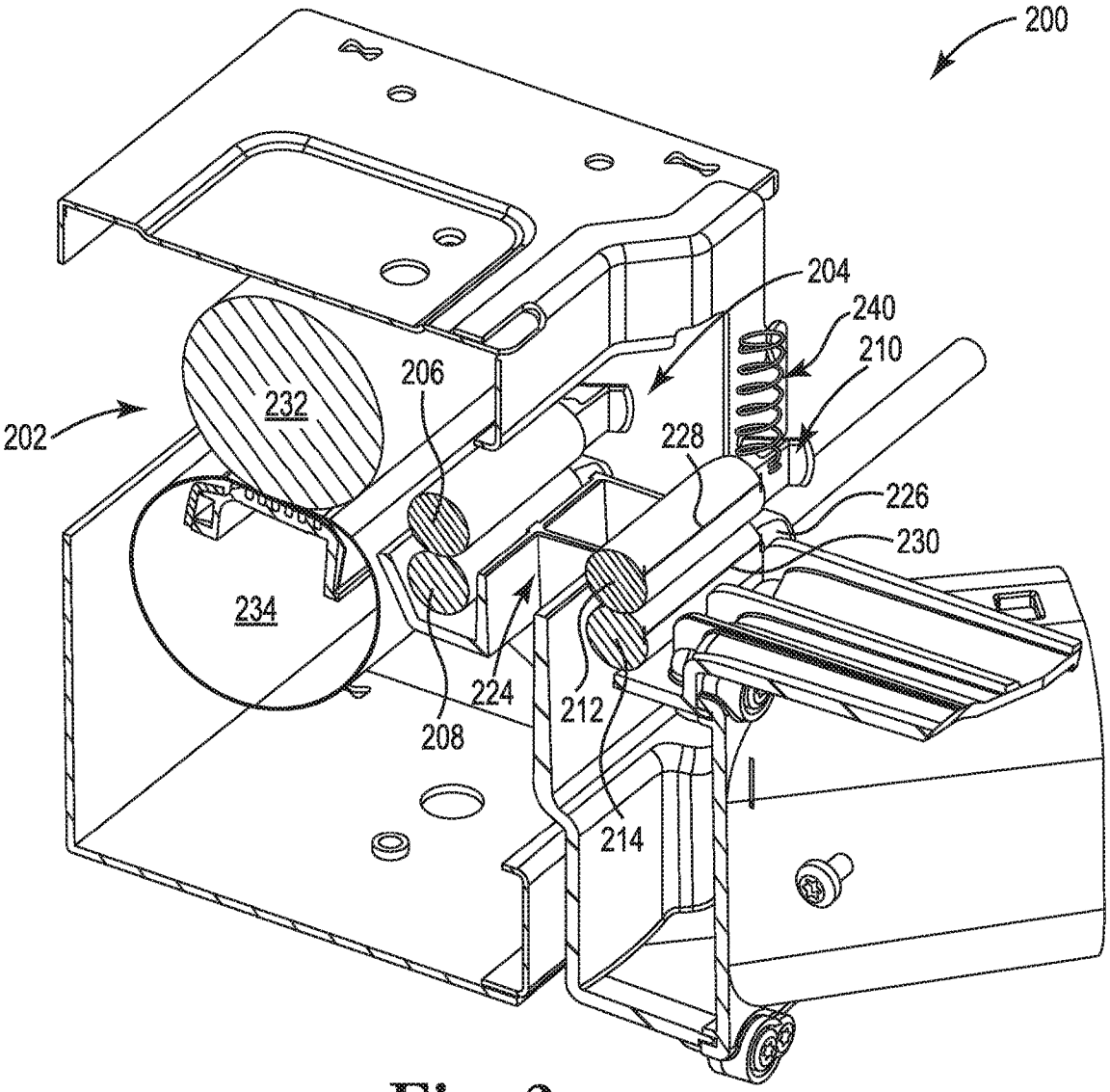
FIG. 2 illustrates an example output tension zone consistent with the present disclosure.

FIG. 2 illustrates an example output tension zone 200 consistent with the present disclosure. The output tension zone 200 as illustrated in FIG. 2 can include similar elements as the output tension zone 100 as referenced in FIG. 1. For example, the output tension zone 200 can include a first tension roller assembly 204 and a second tension roller assembly 210 to receive partially dried inkjet media from a print zone of a printing device and/or a heated pressure roller 202.

In some examples, the heated pressure roller 202 can receive partially dried inkjet media from a print zone of a printing device (e.g., inkjet printer, etc.). As described herein, the partially dried inkjet media can have a number of distorted properties due to the printing fluid or liquid deposited on the partially dried inkjet media. In some examples, the heated pressure roller 202 can include a pressure roller 232 to provide pressure on a first side of the partially dried inkjet media and a heated roller 234 to provide heat on a second side of the partially dried inkjet media. In some examples, the pressure roller 232 can be a continuous roller or cotless roller (e.g., tireless rollers, rollers without a plurality of discrete tires, rollers without a plurality of contact surfaces such as tires, etc.) that can provide pressure on the partially dried inkjet media via a spring mechanism. The pressure roller 232 can be a continuous roller so that pressure is applied substantially evenly across the partially dried inkjet media.

The heated pressure roller 202 can utilize the heated roller 234 to apply heat to the second side of the partially dried inkjet media. In some examples, the heated roller 234 can be solid roller with an integrated heat source. In some examples, the heated roller 234 can be a belt heated roller that includes a belt that transfers heat from a heat source to a second side of the partially dried inkjet media. For example, the heated roller 234 can include a heat source such as a halogen heat source. In this example, the halogen heat source can transfer heat to a belt that can rotate in a clockwise direction to move the partially dried inkjet media to the first tension roller assembly 204. In some examples, the heat transferred to the belt can be transferred to a second side of the partially dried inkjet media. For example, the belt can transfer heat to a bottom side of the partially dried inkjet media as illustrated in FIG. 2.

The heated pressure roller 202 can be utilized to increase a drying rate of the partially dried inkjet media. In some examples, increasing the drying rate of the partially dried inkjet media can generate excess moisture within the output tension zone 200, which can lead to condensation. In addition, increasing the drying rate of the partially dried inkjet media can remove a portion of the distorted features due to the applied printing fluid from the print zone. In some examples, increasing the drying rate can generate additional distorted features when the partially dried inkjet media is not under pressure or tension. For example, increasing the drying rate while a number of cots are positioned on the partially dried inkjet media can cause indentations on the partially dried inkjet media.

The output tension zone 200 can include a first tension roller assembly 204 and a second tension roller assembly 210. As described herein, the first tension roller assembly 204 can be utilized to apply pressure to a first side and a second side of the partially dried inkjet media. In some examples, the first tension roller assembly 204 can receive the partially dried inkjet media from an output of the heated pressure roller 202. The first tension roller assembly 204 can include a first continuous roller 206 to apply pressure to a first side of the partially dried inkjet media and a second continuous roller 208 to apply pressure to a second side of the partially dried inkjet media.

The second tension roller assembly 210 can receive the partially dried inkjet media from the first tension roller assembly 204. The second tension roller assembly 210 can be utilized to apply pressure to the first side and the second side of the partially dried inkjet media. The second tension roller assembly 210 can include a third continuous roller 212 to apply pressure to the first side of the partially dried inkjet media and a fourth continuous roller 214 to apply pressure to the second side of the partially dried inkjet media. As described herein, a continuous roller can include cotless rollers that have substantially equal levels of material that interact with a surface of the partially dried inkjet media.

In some examples, the third continuous roller 212 can include a substantially level surface across a distance 228. As illustrated in FIG. 2, the distance 228 can extend from a first edge of the partially dried inkjet media to a second edge of the partially dried inkjet media. For example, the third continuous roller 212 can include a substantially level surface across a width of the partially dried inkjet media. Similarly, the fourth continuous roller 212 can include a substantially level surface across a distance 230. In some examples, the first continuous roller 206 and second continuous roller 208 can each include substantially level surfaces across the width of the partially dried inkjet media.

As described herein, the first tension roller assembly 204 and the second tension roller assembly 210 can utilize a number of continuous rollers instead of cotted rollers. In addition, the first tension roller assembly 204 and the second tension roller assembly 210 can be utilized to apply tension on the partially dried inkjet media. In these examples, the continuous rollers of the first tension roller assembly 204 and the second tension roller assembly 210 can provide equal tension along a length of the partially dried inkjet media. For example, a cotted roller can provide tension on the partially dried inkjet media that can cause unequal tension and result in "waves" or distortions along the length of the partially dried media at corresponding locations of the plurality of cots. By utilizing continuous rollers without cots, the first tension roller assembly 204 and second tension roller assembly 210 can apply equal tension to remove distorted properties of the partially dried inkjet media without causing waves or distortions from the tension.

In some examples, the number of continuous rollers within the output tension zone 200 can include a spring mechanism (e.g., spring 240, etc.) to apply a force on the number of continuous rollers. As described herein, the spring mechanisms can be utilized to force assemblies of the continuous rollers together to apply pressure on the partially dried inkjet media. For example, the third continuous roller 212 can be connected to a spring 240 that can apply pressure on the third continuous roller 212. In this example, the pressure applied on the third continuous roller 212 can be applied to the first side of the partially dried inkjet media.

In some examples, the number of continuous rollers within the output tension zone 200 can include structural supports (e.g., structural support 226, etc.). In some examples, a width of the number of continuous rollers can be greater than a threshold width. In these examples, the number of continuous rollers can be connected to a structural support so that substantially equal pressure can be applied across the width of the number of continuous rollers. For example, the fourth continuous roller 214 can include a structural support 226 between a first edge of the fourth continuous roller 214 and a second edge of the continuous roller 214. In some examples, the structural support 226 can be connected to a shaft portion of the continuous roller 214 such that a minimal space is attached to the structural support 226.

In some examples, the output tension zone 200 can include a media guide 224 positioned to receive the partially dried inkjet media between the first tension roller assembly 204 and the second tension roller assembly 210. The media guide 224 can be utilized to apply pressure on edges of the partially dried inkjet media. For example, the media guide 224 can provide pressure to a first edge and a second edge of the partially dried inkjet media between the first tension roller assembly and the second tension roller assembly.

In some examples, the media guide 224 can prevent the edges of the partially dried inkjet media from curling and/or cockling during the increased drying within the output tension zone 200. In some examples, the media guide 224 can include rib structures positioned between the first tension roller assembly 204 and the second tension roller assembly 210, In some examples, the rib structures can be utilized to control a leading edge of the partially dried inkjet media while being constrained by the heated pressure roller 202, the first tension roller assembly 204, and/or the second tension roller assembly 210.

In some examples, the output tension zone 200 can provide tension across the length of the partially dried inkjet media utilizing the heated pressure roller 202, the first tension roller assembly 204, and the second tension roller assembly 210. For example, the heated pressure roller 202 can be rotating at a first speed, the first tension roller assembly 204 can be rotating at a second speed, and the second tension roller assembly 210 can be rotating at a third speed. In this example, the third speed can be relatively faster than the second speed, and the second speed can be relatively faster than the first speed. In this example, the second speed can be approximately three percent faster than the first speed and the third speed can be approximately five percent faster than the second speed. As used herein, the term "approximately" includes a variation of one to three percent of the value.

In some examples, the output tension zone 200 can include an air circulation unit that can provide air flow between the first tension roller assembly 204 and the second tension roller assembly 210. For example, the air circulation unit can provide air within the media guide 224. In some examples, exterior air (e.g., air outside the printing device, etc.) can be forced into the output tension zone 200. In some examples, the air circulation unit can force air on a first side of the partially dried inkjet media and/or force air on a second side of the partially dried inkjet media.

The air forced onto the partially dried inkjet media can be utilized to increase drying and/or remove moisture from the output tension zone 200. In some examples, the air circulation unit can force exterior air on to the partially dried inkjet media at an input and allow the air to be forced out of the output tension zone 200 to increase drying and remove moisture from the output tension zone 200. Removing moisture from the output tension zone 200 can limit condensation within the output tension zone 200 which can damage the partially dried inkjet media.

In some examples, the tension roller assemblies 204, 210 can act as an air flow barrier along a direction of the paper feed. As described herein, the tension roller assemblies 204, 210 can utilize continuous rollers instead of cotted rollers. In these examples, the continuous rollers can prevent the air forced onto the partially dried inkjet media from entering surrounding systems of the output tension zone 200. In some examples, the continuous rollers can also prevent heat and/or humidity from entering surrounding systems of the output tension zone 200. In some examples, the continuous rollers can prevent heat from drawn away from the heated pressure roller assembly 202. Thus, the continuous rollers can create an isolated zone between the first tension roller assembly 204 and the second tension roller assembly 204. In some examples, the isolated zone can be more easily controlled. For example, the air flow, temperature, and/or humidity level of the isolated zone can be more easily controlled compared to a non-isolated zone that can result from utilizing cotted rollers.

The air forced onto the partially dried inkjet media can increase drying of the partially dried inkjet media. Increasing the drying of the partially dried inkjet media within the output tension zone 200 can remove a greater quantity of distorted properties. For example, increasing the drying of the partially dried inkjet media while the partially dried inkjet media is under pressure and/or under tension from the tension roller assemblies 204, 210 can remove a greater quantity of distorted properties.

Figure 3:
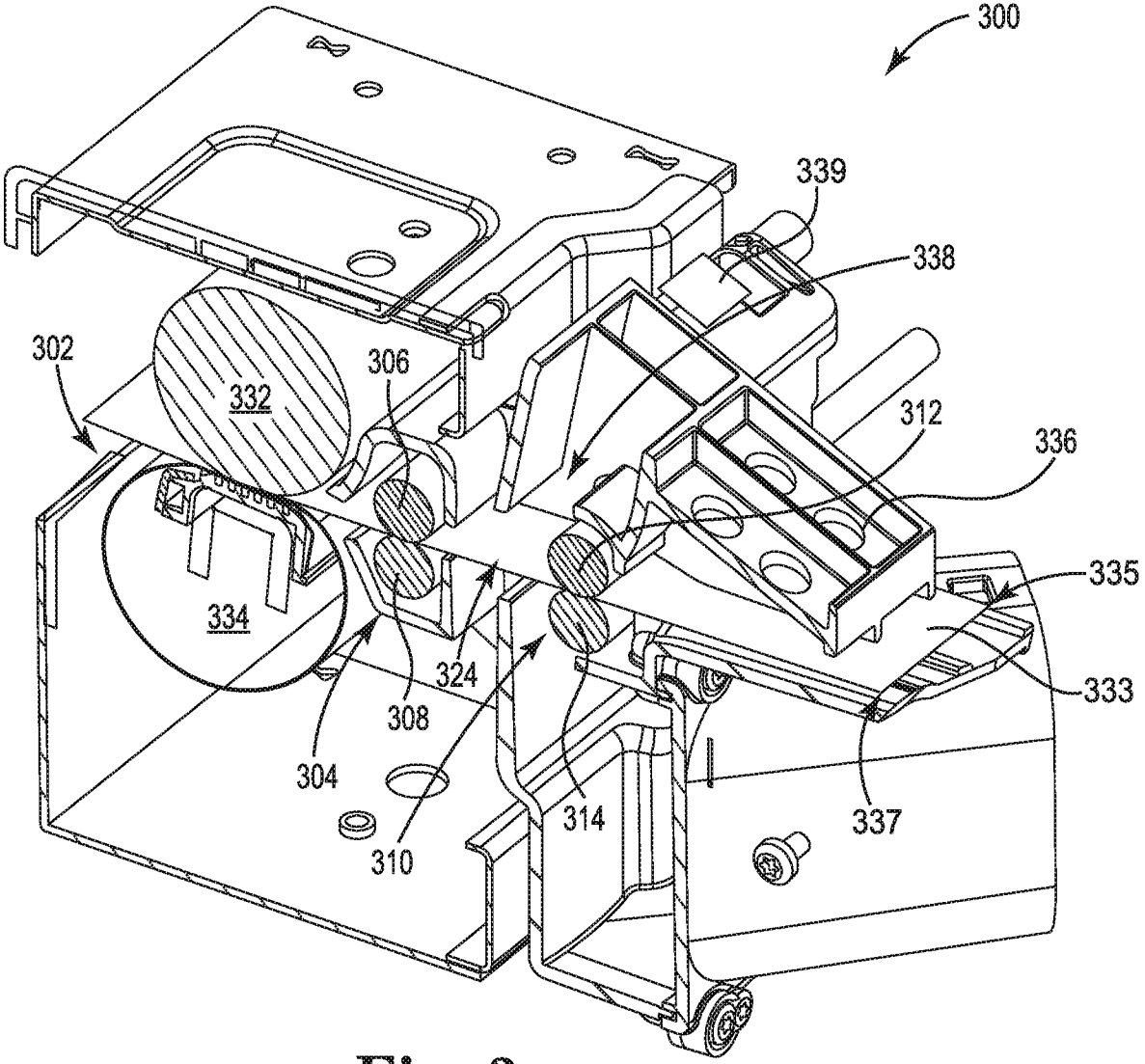
FIG. 3 illustrates an example output tension zone consistent with the present disclosure.

FIG. 3 illustrates an example output tension 300 zone consistent with the present disclosure. The output tension zone 300 as illustrated in FIG. 3 can include similar elements as the output tension zone 100 as referenced in FIG. 1 and/or output tension zone 200 as referenced in FIG. 2. For example, the output tension zone 300 can include a first tension roller assembly 304 and a second tension roller assembly 310 to receive partially dried inkjet media from a print zone of a printing device and/or a heated pressure roller 302.

In some examples, the heated pressure roller 302 can receive partially dried inkjet media from a print zone of a printing device (e.g., inkjet printer, etc.). As described herein, the partially dried inkjet media can have a number of distorted properties due to the printing fluid or liquid deposited on the partially dried inkjet media. In some examples, the heated pressure roller 302 can include a pressure roller 332 to provide pressure on a first side of the partially dried inkjet media and a heated roller 334 to provide heat on a second side of the partially dried inkjet media.

The output tension zone 300 can include a first tension roller assembly 304 and a second tension roller assembly 310. As described herein, the first tension roller assembly 304 can be utilized to apply pressure to a first side and a second side of the partially dried inkjet media. In some examples, the first tension roller assembly 304 can receive the partially dried inkjet media from an output of the heated pressure roller 302. The first tension roller assembly 304 can include a first continuous roller 306 to apply pressure to a first side of the partially dried inkjet media and a second continuous roller 308 to apply pressure to a second side of the partially dried inkjet media.

The second tension roller assembly 310 can receive the partially dried inkjet media from the first tension roller assembly 304. The second tension roller assembly 310 can be utilized to apply pressure to the first side and the second side of the partially dried inkjet media. The second tension roller assembly 310 can include a third continuous roller 312 to apply pressure to the first side of the partially dried inkjet media and a fourth continuous roller 314 to apply pressure to the second side of the partially dried inkjet media. As described herein, a continuous roller can include cotless rollers that have substantially equal levels of material that interact with a surface of the partially dried inkjet media.

As described herein, the first tension roller assembly 304 and the second tension roller assembly 310 can utilize a number of continuous rollers instead of cotted rollers. In addition, the first tension roller assembly 304 and the second tension roller assembly 310 can be utilized to apply tension on the partially dried inkjet media. In these examples, the continuous rollers of the first tension roller assembly 304 and the second tension roller assembly 310 can provide equal tension along a length of the partially dried inkjet media. For example, a cotted roller can provide tension on the partially dried inkjet media that can cause unequal tension and result in "waves" or distortions along the length of the partially dried media at corresponding locations of the plurality of cots. By utilizing continuous rollers without cots, the first tension roller assembly 304 and second tension roller assembly 310 can apply equal tension to remove distorted properties of the partially dried inkjet media without causing waves or distortions from the tension.

In some examples, the output tension zone 300 can include a media guide 324 positioned to receive the partially dried inkjet media between the first tension roller assembly 304 and the second tension roller assembly 310. The media guide 324 can be utilized to apply pressure on edges of the partially dried inkjet media. For example, the media guide 324 can provide pressure to a first edge 335 and a second edge 337 of the partially dried inkjet media (e.g., partially dried inkjet media 333, etc.) between the first tension roller assembly 304 and the second tension roller assembly 310. In some examples, the media guide 324 can prevent the edges of the partially dried inkjet media from curling and/or cockling during the increased drying within the output tension zone 300.

In some examples, the output tension zone 300 can include an air circulation unit 339 that can provide air flow between the first tension roller assembly 304 and the second tension roller assembly 310. For example, the air circulation unit 339 can provide air within the media guide 324. In some examples, exterior air (e.g., air outside the printing device, etc.) can be forced into the output tension zone 300 through an input 338. In this example, the air forced into the input 338 can make contact with the partially dried inkjet media within the media guide 324. In some examples, the forced air can exit the output tension zone 300 through an output 336. In some examples, the air circulation unit 339 can force air on a first side of the partially dried inkjet media and/or force air on a second side of the partially dried inkjet media.

The air forced onto the partially dried inkjet media can be utilized to increase drying and/or remove moisture from the output tension zone 300. In some examples, the air circulation unit 339 can force exterior air on to the partially dried inkjet media at the input 338 and allow the air to be forced through an output 336 of the output tension zone 300 to increase drying and remove moisture from the output tension zone 300. Removing moisture from the output tension zone 300 can limit condensation within the output tension zone 300 which can damage the partially dried inkjet media. In some examples, the air circulation unit 339 can force air on to the partially dried inkjet media on the second side through a corresponding input and output.

In some examples, the tension roller assemblies 304, 310 can act as an air flow barrier along a direction of the paper feed. As described herein, the tension roller assemblies 304, 310 can utilize continuous rollers instead of cotted rollers. In these examples, the continuous rollers can prevent the air forced onto the partially dried inkjet media from entering surrounding systems of the output tension zone 300. In some examples, the continuous rollers can also prevent heat and/or humidity from entering surrounding systems of the output tension zone 300. In some examples, the continuous rollers can prevent heat from drawn away from the heated pressure roller assembly 302. Thus, the continuous rollers can create an isolated zone between the first tension roller assembly 304 and the second tension roller assembly 304. In some examples, the isolated zone can be more easily controlled. For example, the air flow, temperature, and/or humidity level of the isolated zone can be more easily controlled compared to a non-isolated zone that can result from utilizing cotted rollers.

The air forced onto the partially dried inkjet media can increase drying of the partially dried inkjet media. Increasing the drying of the partially dried inkjet media within the output tension zone 300 can remove a greater quantity of distorted properties. For example, increasing the drying of the partially dried inkjet media while the partially dried inkjet media is under pressure and/or under tension from the tension roller assemblies 304, 310 can remove a greater quantity of distorted properties.

The above specification, examples and data provide a description of the method and applications, and use of the system and method of the present disclosure. Since many examples can be made without departing from the spirit and scope of the system and method of the present disclosure, this specification merely sets forth some of the many possible example configurations and implementations.

What is claimed:

1. An output tension zone, comprising:

a first tension roller assembly to receive partially dried inkjet media at an output of a heated pressure roller, wherein the first tension roller assembly includes a first continuous roller to receive a first side of the partially dried inkjet media and a second continuous roller to receive a second side of the partially dried inkjet media;

a second tension roller assembly to receive the partially dried inkjet media from the first tension roller assembly, wherein the second tension roller assembly includes a third continuous roller to receive the first side of the partially dried inkjet media and a fourth continuous roller to receive the second side of the partially dried inkjet media; and a media guide positioned between the first tension roller assembly and the second tension roller assembly to direct air from an air circulation unit that includes a fan to increase drying of the partially dried inkjet media when the first tension roller assembly and the second tension roller assembly apply pressure to the partially dried inkjet media.

2. The output tension zone of claim 1, wherein the media guide provides pressure to an edge of the partially dried inkjet media between the first tension roller assembly and the second tension roller assembly.

3. The output tension zone of claim 1, wherein the first continuous roller and the second continuous roller include a continuous roller size across a width of the partially dried inkjet media.

4. The output tension zone of claim 1, wherein the third continuous roller and the fourth continuous roller include a polytetrafluoroethylene (PTFE) coated continuous roller size across a width of the partially dried inkjet media.

5. A system for an output tension zone, comprising:

a heated pressure roller to receive partially dried inkjet media from a print zone; and a tension zone to receive the partially dried inkjet media, the tension zone comprising:

a first assembly of continuous rollers to apply pressure along a first side and second side of the partially dried inkjet media;

a media guide to receive a first edge and a second edge of the partially dried inkjet media from the first assembly of continuous rollers to direct air from a fan to increase drying of the partially dried inkjet media when the first assembly of continuous rollers and a second assembly of continuous rollers apply pressure to the partially dried inkjet media; and the second assembly of continuous rollers to apply pressure along the first side and second side of the partially dried inkjet media.

6. The system of claim 5, wherein air is moved on to the partially dried inkjet media within the media guide.

7. The system of claim 5, wherein the heated pressure roller moves at a first speed, the first assembly of continuous rollers move at a second speed, and the second assembly of continuous rollers move at a third speed to apply tension on the partially dried inkjet media.

8. The system of claim 5, wherein first assembly of continuous rollers applies a first tension or pressure to the partially dried inkjet media and the second assembly of continuous rollers applies a second tension or pressure to the partially dried inkjet media.

9. The system of claim 5, wherein the first assembly of continuous rollers include a first continuous roller comprising a solid core with a continuous coating to soften the first continuous roller and a second continuous roller comprising a continuous metallic roller.

10. The system of claim 9, wherein the first continuous roller contacts a printed side of the partially dried inkjet media and the second continuous roller contacts a non-printed side of the partially dried inkjet media.

11. An output tension zone, comprising:

a first assembly of continuous rollers to apply pressure along a first side and second side of partially dried inkjet media, wherein the first assembly of continuous rollers includes a first continuous roller with a first continuous material to apply pressure across the first side of the partially dried inkjet media and a second continuous roller with a second continuous material to apply pressure across the second side of the partially dried inkjet media;

a media guide to receive a first edge and a second edge of the partially dried inkjet media from the first assembly of continuous rollers;

an air circulation unit to provide air to the first side and the second side of the partially dried inkjet media within the media guide, wherein the air circulation unit includes a fan to increase drying of the partially dried inkjet media when the first assembly of continuous rollers and second assembly of continuous rollers apply pressure to the first side and second side of the partially dried inkjet media; and a second assembly of continuous rollers to receive the partially dried inkjet media from the media guide to apply pressure along the first side and second side of the partially dried inkjet media.

12. The output tension zone of claim 11, wherein the first continuous material has a first level of hardness and the second continuous material has a second level of hardness.

13. The output tension zone of claim 12, wherein the first continuous material of the first continuous roller applies pressure to a printed side of the partially dried inkjet media when the first level of hardness is softer than the second level of hardness.

* * * * *